US010153109B2

(12) United States Patent
Terada et al.

(10) Patent No.: US 10,153,109 B2
(45) Date of Patent: Dec. 11, 2018

(54) GAS CIRCUIT BREAKER

(71) Applicant: Hitachi, Ltd., Chiyoda-ku, Tokyo (JP)

(72) Inventors: Masanao Terada, Tokyo (JP); Hiroaki Hashimoto, Tokyo (JP); Riichi Nagao, Tokyo (JP); Yu Hasegawa, Tokyo (JP); Takashi Iida, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 15/428,364

(22) Filed: Feb. 9, 2017

(65) Prior Publication Data

US 2017/0250039 A1 Aug. 31, 2017

(30) Foreign Application Priority Data

Feb. 25, 2016 (JP) ..... 2016-033739

(51) Int. Cl.
*H01H 33/42* (2006.01)
*H01H 33/56* (2006.01)

(52) U.S. Cl.
CPC ..... *H01H 33/42* (2013.01); *H01H 33/565* (2013.01)

(58) Field of Classification Search
CPC ..... H01H 33/42; H01H 33/565; H01H 33/50; H01H 33/46; H01H 33/91; H01H 33/70; H01H 2205/002; H01H 3/42; H01H 2033/028
USPC ..... 218/154, 13, 14, 57, 59–61, 155
See application file for complete search history.

(56) References Cited

U.S. PATENT DOCUMENTS 6,271,494 B1 8/2001 Dienemann et al.
7,642,480 B2 * 1/2010 Ozil ..... H01H 33/904 218/14
8,304,677 B2 * 11/2012 Yoon ..... H01H 33/904 218/78

(Continued)

FOREIGN PATENT DOCUMENTS

JP 2003-109480 A 4/2003
JP WO2015029516 * 3/2015 ..... H01H 33/42
JP WO2015064215 * 5/2015 ..... H01H 33/42

OTHER PUBLICATIONS

Translation of WO2015029516 (U.S. Pat. No. 9,620,315 published Apr. 2017).*
Translation of WO2015064215 (Original published May 2015).*

*Primary Examiner* — Renee Luebke
*Assistant Examiner* — William Bolton
(74) *Attorney, Agent, or Firm* — Crowell & Moring LLP

(57) ABSTRACT

To provide a gas circuit breaker having a space-saving reliable double motion mechanism having a high degree of freedom in design. A double motion mechanism section of the gas circuit breaker is formed of a drive-side connecting rod, a driven-side connecting rod, levers connecting them and a guide regulating operations of the drive-side connecting rod and the driven-side connecting rod. A movable pin is connected to a first grooved cam formed in the drive-side connecting rod, a second grooved cam formed in the guide and third grooved cams formed in the levers respectively, and posture holding members are provided in the movable pin. The movable pin moves in the respective grooved cams by an operation of the drive-side connecting rod, thereby rotating the levers, driving the driven-side connecting rod in an opposite direction of the drive-side connecting rod, and driving the driven-side arcing contact in an opposite direction of the driven-side arcing contact.

12 Claims, 6 Drawing Sheets

(56) References Cited

U.S. PATENT DOCUMENTS

| | | | | |
|---|---|---|---|---|
| 8,698,033 | B2 * | 4/2014 | Ozil | H01H 33/24 218/53 |
| 9,620,315 | B2 * | 4/2017 | Terada | H01H 33/42 |
| 2012/0103940 | A1 * | 5/2012 | Ohda | H01H 33/166 218/50 |

* cited by examiner

[FIG. 1]
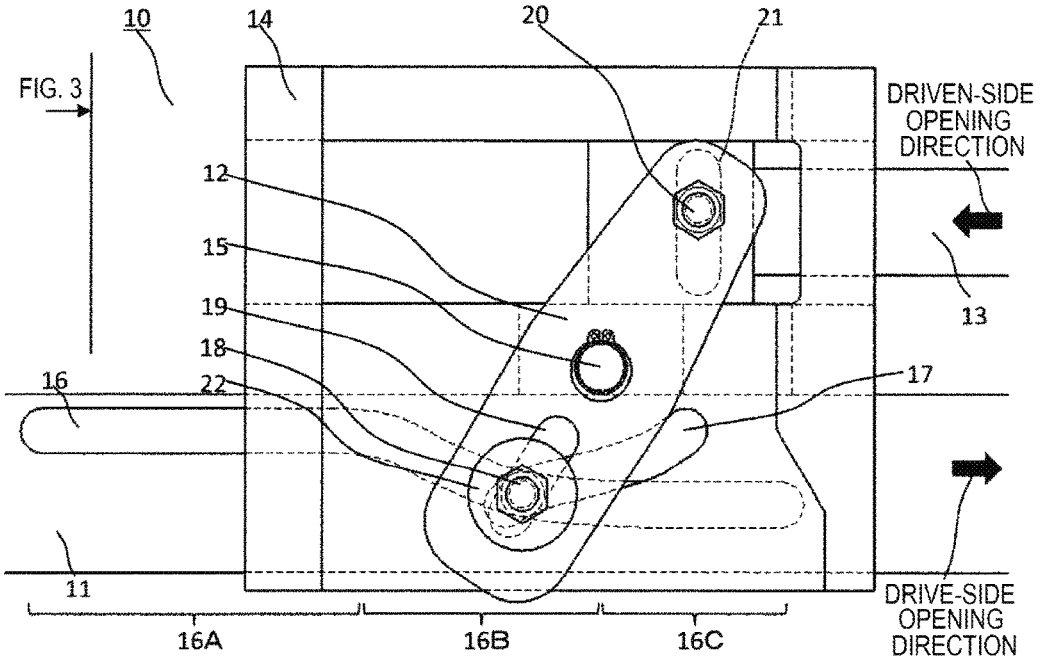

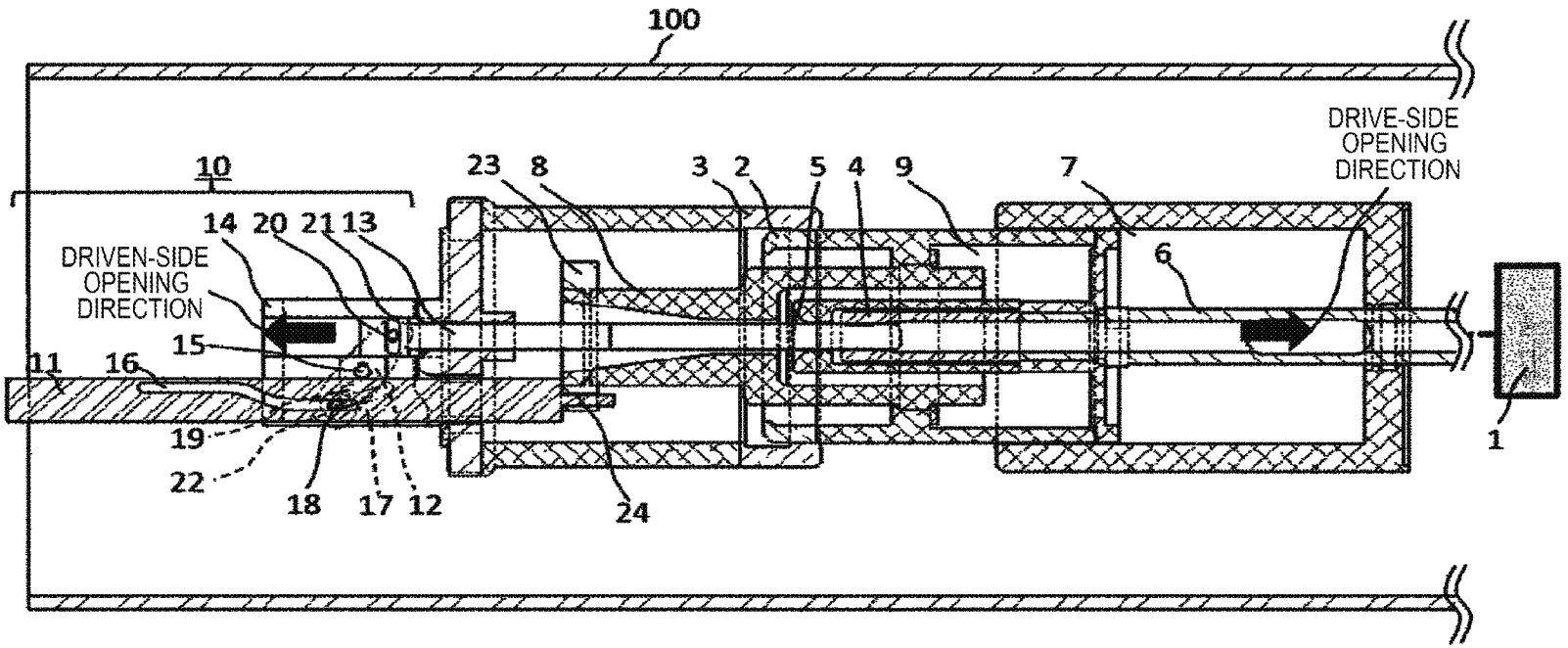
[FIG. 2]

[FIG. 3]
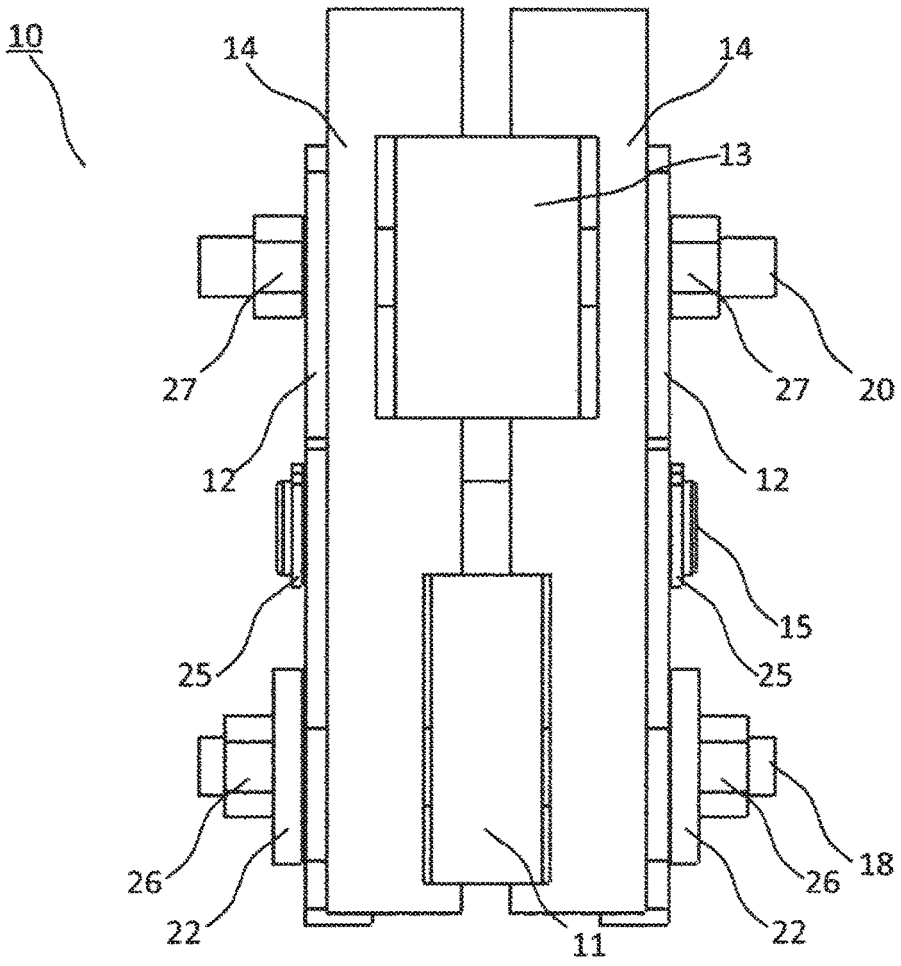

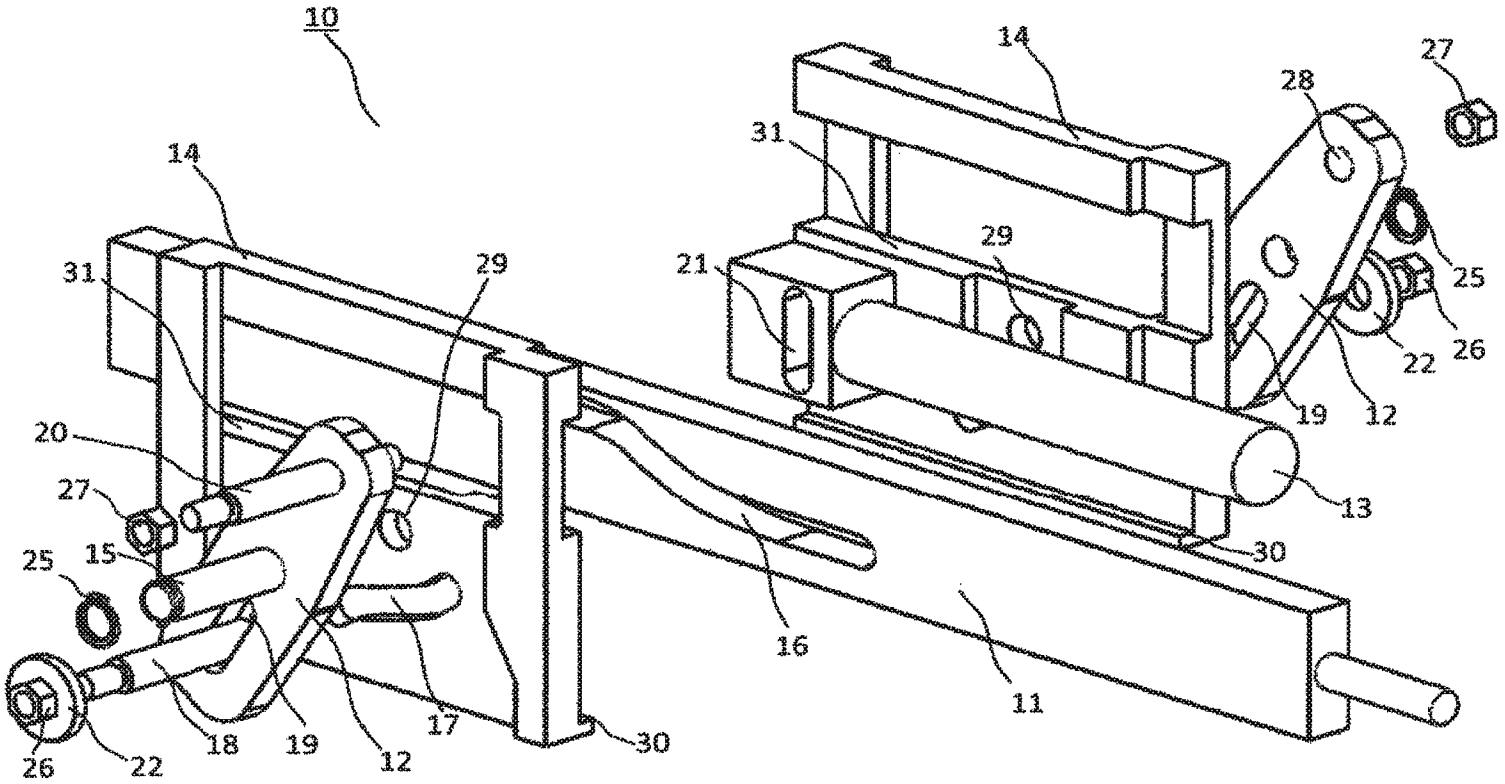
[FIG. 4]

Sectional view A-A'

[FIG. 6]
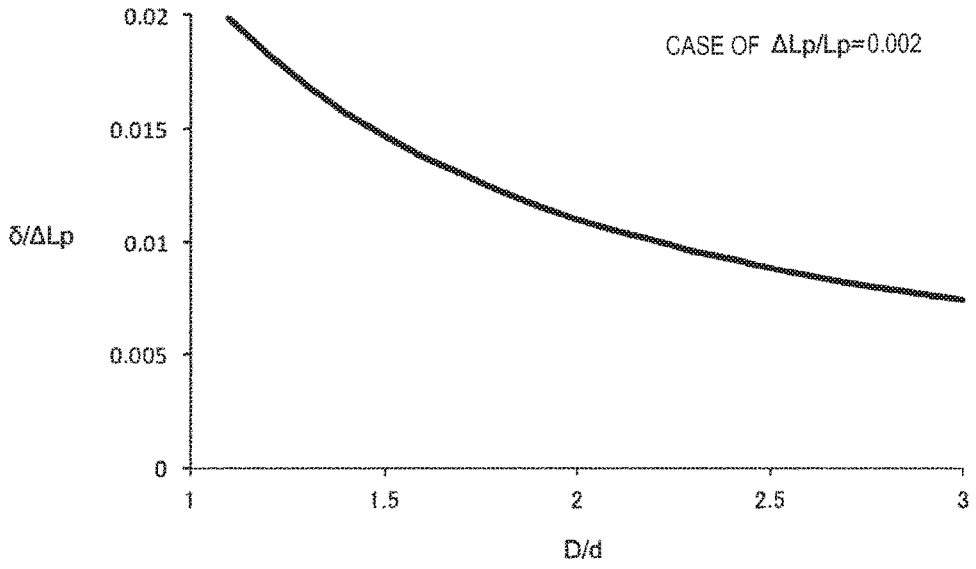

GAS CIRCUIT BREAKER

TECHNICAL FIELD

The present invention relates to a gas circuit breaker adopting a double motion mechanism which drives electrodes in opposite directions to each other.

BACKGROUND ART

As a gas circuit breaker used for a high-voltage power system, a so-called puffer-type gas circuit breaker is generally used, which breaks electric current by using pressure increase of an extinguishing gas during an opening operation and by blowing a compressed gas to an arc generated between electrodes.

In order to improve circuit-breaking performance of the puffer-type gas circuit breaker, a double motion system in which an electrode on a driven side which has been fixed in related art is driven in an opposite direction of a driving direction of a drive-side electrode is proposed.

For example, a system using a fork-shaped lever is proposed in Patent Literature 1. In this invention, the fork-shaped lever rotates when a pin interlocked with the movement on a drive side touches a recess of the fork, and the rotation is converted into a reciprocating motion in a direction of an opening/closing shaft, thereby driving a driven-side arcing contact in an opposite direction of the driving direction of the drive-side electrode. In a state where the pin is separated from the recess of the fork, the lever maintains the position and the driven-side arcing contact is stationary.

An object of the invention is to move the driven side efficiently with the minimum driving force in a time domain necessary for breaking electric current.

Moreover, a double motion system using a grooved cam is proposed in Patent Literature 2. In this system, a pin moves inside the grooved cam in accordance with the movement of a drive side, and the cam is rotated to thereby drive a driven side arcing contact coupled to the cam in an opposite side of a drive side electrode. A desired speed ratio between the driven-side arcing contact and the drive-side electrode can be realized by forming the grooved cam in an arbitrary shape.

CITATION LIST

Patent Literature

Patent Literature 1: U.S. Pat. No. 6,271,494
Patent Literature 2: JP-A-2003-109480

SUMMARY OF INVENTION

Technical Problem

However, the shape of the fork-shaped lever described in Patent Literature 1 is formed only by a straight line portion and an arc portion, therefore, there is a problem that the speed on the driven side is not capable of being arbitrarily set. Moreover, as the pin touches the recess of the fork-shaped lever at every opening/closing operation, there is a danger that an excessive force is added to the fork-shaped lever.

Although the speed on the driven side can be arbitrarily set by the grooved cam in Patent Literature 2, the grooved cam has an approximately arc shape and the driven side constantly operates with respect to the movement on the drive side, therefore, it is difficult to limit the movement on the driven side to be performed in a desired time domain. Moreover, as the groove cam has the approximately arc shape, there is a problem that an apparatus is increased in size.

Solution to Problem

In a gas circuit breaker according to the invention, a drive-side electrode and a driven-side electrode are provided so as to face each other inside a sealed tank 100, the drive-side electrode has a drive-side main electrode 2 and a drive-side arcing contact 4, and the driven-side electrode includes a driven-side main electrode 3 and a driven-side arcing contact 5, the drive-side arcing contact 4 is connected to an actuator 1, and the driven-side arcing contact 5 is connected to a double motion mechanism section 10. The double motion mechanism section 10 includes a drive-side connecting rod 11 receiving a driving force from the drive-side electrode, a driven-side connecting rod 13 connecting to the driven-side arcing contact 5, two levers 12 operating the driven-side connecting rod 13 in an opposite direction with respect to an operation of the drive-side connecting rod 11, and a guide 14 in which the drive-side connecting rod 11 and the driven-side connecting rod 13 move thereinside, the two levers 12 are arranged on both sides of the guide 14, which are fixed to each other so as to rotate freely by a lever fixing member 15, a movable pin 18 is connected to a first grooved cam 16 formed in the drive-side connecting rod 11, a second grooved cam 17 formed in the guide and third grooved cams 19 formed in the two levers 12 respectively, and posture holding members 22 which hold the movable pin 18 so that the movable pin 18 is approximately orthogonal to an opening/closing operation shaft of a circuit breaker part are provided.

Advantageous Effects of Invention

According to the invention, shapes of grooved cams which can minimize energy of the actuator while securing the circuit breaking performance can be realized, and operation energy can be reduced as compared with a related-art double motion system. Moreover, a space saving and reliable double motion mechanism can be realized.

BRIEF DESCRIPTION OF DRAWINGS

FIG. 1 is a detail view of a double motion mechanism of a gas circuit breaker according to an embodiment of the invention.

FIG. 2 is a view showing a closing state of the gas circuit breaker according to the embodiment of the invention.

FIG. 3 is a front view of the double motion mechanism of the gas circuit breaker according to the embodiment of the invention.

FIG. 4 is an exploded perspective view of the double motion mechanism of the gas circuit breaker according to the embodiment of the invention.

FIG. 6 is a chart showing a relation between the diameter of a posture holding member and a posture deviation amount of the gas circuit breaker according to the embodiment of the invention.

DESCRIPTION OF EMBODIMENTS

Figure 5A:
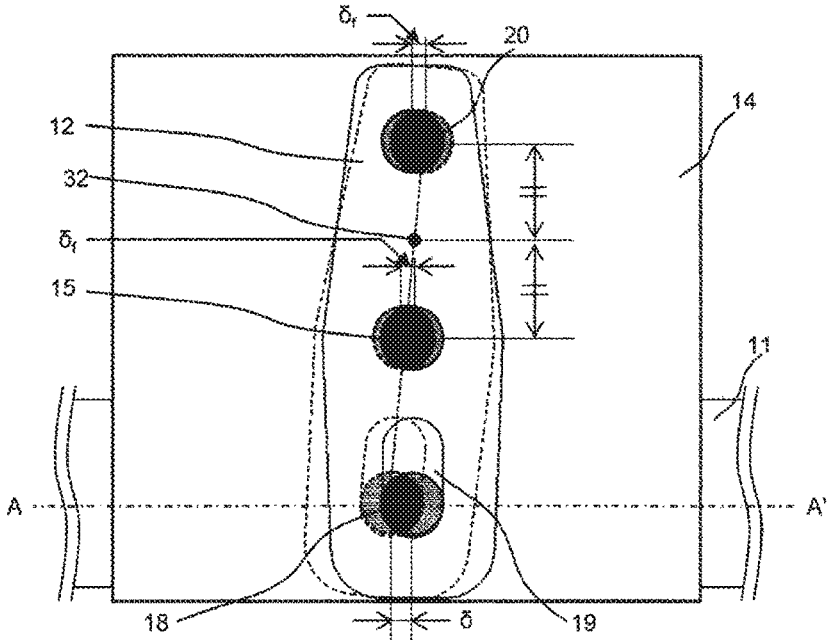
FIG. 5A is a schematic view indicating a posture deviation of a movable pin in the gas circuit breaker according to the embodiment of the invention.

Hereinafter, a gas circuit breaker according to an embodiment of the invention will be explained with reference to the drawings. The following is just an embodiment, which does not intend to limit the contents of the invention to the following specific examples. The invention itself can be achieved in various manners so as to correspond to the contents described in claims. In the following embodiment, a circuit breaker having a mechanical compression chamber and a thermal expansion chamber is explained as an example, however, the invention of the present application may be applied to, for example, a circuit breaker having only the mechanical compression chamber.

In a gas circuit breaker according to an embodiment of the invention, a first grooved cam including an arbitrary curved portion and a straight line portion is drilled in a rod connecting to a drive side, a second grooved cam in which a movable pin functions as a stopper for suppressing movement of a driven side when the movable pin exists in the straight line portion and the movable pin functions as a guide for movement of the pin when the movable pin exists in the curved portion is drilled in guide plates which sandwich the driven-side connecting rod from both sides, the movable pin is inserted into grooves cut in two levers having the same shape provided on outer sides of the guide plates and posture holding members suppressing rotation of the movable pin around two axes perpendicular to a pin axis are provided on both ends of the movable pin so that a speed ratio between the drive side and the driven side is variable as well as intermittent driving is possible, in which the levers rotate with movement of the movable pin to thereby move the driven-side electrode in an opposite direction of the drive side.

Example 1

FIG. 2 shows an input state of a gas circuit breaker according to an embodiment of the invention.

A drive electrode and a driven electrode are coaxially provided so as to face each other inside a sealed tank 100. The drive-side electrode includes a drive-side main electrode 2 and a drive-side arcing contact 4, and the driven-side electrode includes a driven-side main electrode 3 and a driven-side arcing contact 5.

An actuator 1 is provided adjacent to the sealed tank 100. A shaft 6 is coupled to the actuator 1, and the drive-side arcing contact 4 is provided at a tip end of the shaft 6. The shaft 6 and the drive-side arcing contact 4 are provided so as to penetrate inside a mechanical compression chamber 7 and a thermal expansion chamber 9.

The drive-side main electrode 2 and a nozzle 8 are provided on a circuit breaker part side of the thermal expansion chamber 9. The driven-side arcing contact 5 is provided so as to face the drive-side arcing contact 4 on the same axis. One end of the driven-side arcing contact 5 and a tip portion of the nozzle 8 are connected to a double motion mechanism section 10.

As shown in FIG. 2, the gas circuit breaker is set in a position where the drive-side main electrode 2 and the driven-side main electrode 3 are electrically connected by a drive source using a hydraulic pressure or a spring of the actuator 1 in an input state, which forms a circuit of a power system in the normal state.

When breaking a short-circuit current due to lightning, the actuator 1 is driven in an opening direction to separate the drive-side main electrode 2 from the driven-side main electrode 3 through the shaft 6. At this time, an arc is generated between the drive-side arcing contact 4 and the driven-side arcing contact 5. The arc is extinguished by mechanical blowing of an extinguishing gas by the mechanical compression chamber 7 and blowing of the extinguishing gas using arc heat by the thermal expansion chamber 9, thereby breaking electric current.

In order to reduce operation energy of a puffer-type gas circuit breaker, the double motion mechanism section 10 which drives the driven-side arcing contact which has been fixed in related art in an opposite direction of a driving direction of a drive-side electrode is provided. Hereinafter, a double motion system according to the embodiment of the invention will be explained with reference to FIG. 1.

The double motion mechanism section 10 according to the invention is configured by connecting a driven-side connecting rod 13 and a drive-side connecting rod 11 by levers 12 provided in a guide 14 so as to rotate freely while holding the driven-side connecting rod 13 and the drive-side connecting rod 11 by the guide 14 in a direction of breaking operation so as to move freely.

A first grooved cam 16 is drilled in the drive-side connecting rod 11, which has a second straight line portion 16C, a connecting portion 16B and a first straight line portion 16A seen from the actuator side. The first straight line portion 16A and the second straight line portion 16C are arranged on different axis lines from each other, and the connecting portion 16B is provided therebetween.

The first grooved cam 16 is formed so that a displacement width thereof in a vertical direction falls within a displacement width of a second grooved cam 17 in the vertical direction and a displacement width of a third grooved cam 19 in the vertical direction. A shape of the connecting portion 16B may be arbitrarily designed in accordance with operation characteristics of a circuit breaker part, and for example, a curve or a straight line can be considered.

As displacement of the drive-side connecting rod 11 in the vertical direction is limited by a groove (30 in FIG. 4) formed in the guide 14, the drive-side connecting rod 11 can move only in a direction horizontal to an operation shaft of the circuit breaker part.

A second grooved cam 17 which is equal to a width of the first grooved cam 16 in the vertical direction and is formed in a curve is drilled in the guide 14 as shown in FIG. 1. The shape of the second grooved cam 17 is not limited to the curve but may be appropriately changed in accordance with breaking operation characteristics. The first grooved cam 16 and the second grooved cam 17 have a stacked structure in a direction perpendicular to the sheet, and a movable pin 18 is arranged in an overlapping part of both grooved cams to be connected to each other so that the pin can move freely (see FIG. 4).

Moreover, the movable pin 18 is inserted to the third grooved cam 19 drilled in the lever 12, and the lever 12 rotates around a lever fixing pin 15 as a rotation axis. At this time, the movable pin 18 moves while rolling in the second grooved cam 17 in one direction when moving on the connecting portion 16B of the first grooved cam. Due to the movement of the movable pin 18 in one direction, a force acts on one side of an inner wall of the third grooved cam 19, which limits a rotation direction of the lever 12. The shape of the third grooved cam 19 is not particularly limited and can be appropriately changed in accordance with the breaking operation characteristics.

A driven-side moving pin 20 attached to the lever 12 transmits the force to a guide groove 21 drilled in the driven-side connecting rod 13 by the above rotating motion, thereby driving the driven-side connecting rod 13 connecting to the driven-side arcing contact 5 in an opposite direction to the drive-side connecting rod 11.

As displacement of the driven-side connecting rod 13 in the vertical direction is limited by a groove (31 in FIG. 4) provided in the guide 14, the driven-side connecting rod 13 can move only in a direction horizontal to the operation shaft of the circuit breaker part.

The connection between the double motion mechanism section 10 and the drive side is performed by, for example, attaching a fastening ring 23 in the nozzle 8 and providing a hole through which a tip portion of the drive-side connecting rod 11 penetrates in the fastening ring 23 to thereby fasten a drive-side fastening screw 24 by a nut.

FIG. 3 shows a front view of the double motion mechanism according to the embodiment of the invention and FIG. 4 shows an exploded perspective view of the double motion mechanism according to the embodiment of the invention.

Two levers 12 are attached to the outside of the guide 14 in the same shape. The movable pin 18 penetrates through the second grooved cam 17 in the guide 14, the first grooved cam 16 in the drive-side connecting rod 11 and the third grooved cams 19 in the levers 12. The movable pin 18 is not fixed to any portion and can move freely in respective grooves. However, rotations around two axes orthogonal to an axis of the movable pin can occur as the degree of freedom in operation is high. Due to the rotations, abutting manners between the pin and three kinds of grooves vary on right-and-left both sides in FIG. 3, a contact force may be locally increased and fixed stagnation may occur between the pin and the grooves. In response to this, posture holding members 22 are provided on both ends of the movable pin 18. The posture holding members 22 are fixed by movable pin fastening nuts 26.

The driven-side moving pin 20 penetrates through the levers 12 (lever driven-side holes 28) and the driven-side connecting rod 13 (the guide groove 21), which is fixed by moving pin fastening nuts 27 from both sides.

The lever fixing pin 15 is provided with fixing rings 25 on both ends to prevent falling off from the guide 14.

A length of a cylindrical portion of the movable pin 18 is set to be longer than a thickness of the levers 12 and the guide 14 in the stacked direction so that the movable pin 18 can move freely in the grooved cam.

As the lever fixing pin 15 is constantly stationary during the operation and is not necessary to be firmly fastened by a bolt/nut, the fixing rings are attached, however, the lever fixing pin 15 may be fastened by nuts in the same manner as the movable pin 18 and the driven-side moving pin 20.

The driven-side moving pin 20 penetrates through the lever driven-side holes 28 and the guide groove 21, however, it is also preferable that the lever 12 has a long hole and the driven-side connecting rod 13 has a circular hole.

Figure 5B:
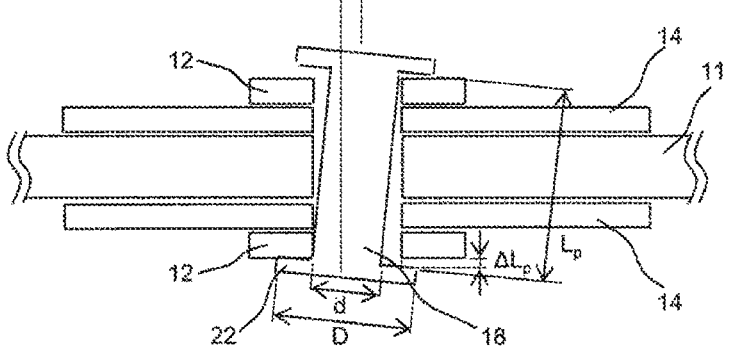
FIG. 5B is a sectional view indicating a posture deviation of a movable pin in the gas circuit breaker according to the embodiment of the invention.

FIG. 5A shows a schematic view indicating a posture deviation of the movable pin in the gas circuit breaker according to the embodiment of the invention. FIG. 5B shows a sectional view where the movable pin 18 rotates around an axis in a direction perpendicular to the sheet of the drawing due to backlash with respect to the respective third grooved cams 19, the first grooved cam 16 and the second grooved cam (see FIG. 4 respectively) is considered. A deviation of the movable pin 18 between centers in this side on the sheet and in the back side is denoted by "δ". The lever fixing pin 15 and the driven-side moving pin 20 have fitting structures with respect to lever-fixing pin holes 29 and lever driven-side holes 28 respectively, therefore, a force of causing the deviation δ between the centers on both ends of the moving pin 18 is transmitted to the levers 12, and the respective pins bend by "δf" due to a force of torsion around a middle point (torsional rotation center 32) of a line segment connecting between centers of respective pins 15 and 20 as an axis. When the deviation δ between the centers on both ends of the moving pin 18 is increased, δf is increased. When δf is increased, the stress acting on the pins is increased, and when the stress largely exceeds a yield point determined by a diameter, a length and a material of the pins, plastic deformation is caused, which leads to the fixed stagnation and the breaking between components.

On the other hand, when the both ends of the movable pin 18 are pressed by the posture holding members 22 according to the invention, an inner surface of the posture holding member 22 touches an outer surface of the lever 12 and a force to return the pin to the original posture acts even if the movable pin 18 is inclined, therefore, the inclination of the lever 12 is suppressed and the breaking does not occur.

When the posture holding member is formed as a circular washer-type, a relation shown in FIG. 6 holds between a ratio between an outer diameter D/a pin diameter "d" and the deviation δ in the centers on both ends of the movable pin 18. The vertical axis represents (δ/ΔLp) and the horizontal axis represents (D/d), and a ratio (ΔLp/Lp) between backlash (ΔLp) in the end surface of the lever 12 and the posture holding member 22 and the pin length (Lp) is set to 0.002. As can be easily anticipated, δ is reduced as (D/d) is increased, and the movable 18 is not inclined easily.

The case where the posture holding members are formed as the circular washer type has been explained, however, a rectangular washer type can be also adopted. The shape of the posture holding members is not particularly limited as long as an axis of the movable pin 18 is held in a state of being approximately orthogonal to the opening/closing operation shaft of the circuit breaker part by holding the posture holding members 22 touched to both ends of the levers 12, however, it is preferable to adopt a thin flat-plate shape in consideration of size reduction. When considering the size reduction, the posture holding members 22 are preferably fixed to both ends of the movable pin 18. A structure in which the posture holding members 22 are integrally formed on both ends of the movable pin 18 can be considered.

In the embodiment, the first grooved cam 16 and the second grooved cam 17 overlap each other in the axial direction of the movable pin 18 as shown in FIG. 3, thereby realizing the space-saving double motion mechanism. Furthermore, the movable pin 18 is not fixed to any of portions having the grooved cams, and the axis of the movable pin 18 is held in a state of being approximately orthogonal to the opening/closing operation shaft of the circuit breaker part, therefore, an excessive force acting on the movable pin 18 can be alleviated and a reliable double motion mechanism can be realized.

Moreover, as the degree of freedom in designing the first grooved cam is high, the design change can be easily performed in accordance with kinds of machines having different structures of the circuit breaker part and circuit breaking systems, and the optimum curved shape to secure the circuit breaking performance can be designed. As the length and the area of the straight line portion can be set freely, the driven side can be moved only in an arbitrary time domain.

The above operation is especially effective for breaking a small capacitive current. It is necessary that a breakdown voltage between electrodes in each time of circuit breaking exceeds a recovery voltage in the small capacitive current breaking. That is because it is necessary to secure a distance between electrodes as long as possible at a short period of time as the breakdown voltage between electrodes depends on the distance between electrodes at each time.

The shapes of the grooved cams of the double motion mechanism which can realize stroke characteristics necessary for breaking the small capacitive current have been shown in the embodiment, however, the optimum stroke characteristics exist with respect to various types of breaking duties, and these can be realized by changing the shape of the connection portion 16B formed by an arbitrary curve in the embodiment.

A speed ratio of the driven-side operation with respect to the drive-side operation can be changed by adjusting the positional relation among the first straight line portion 16A, second straight line portion 16C, connecting portion 16B of the first grooved cam, the second grooved cam 17 and the third grooved cams 19.

REFERENCE SIGNS LIST

1 actuator
2 drive-side main electrode
3 driven-side main electrode
4 drive-side arcing contact
5 driven-side arcing contact
6 shaft
7 mechanical compression chamber
8 nozzle
9 thermal expansion chamber
10 double motion mechanism section
11 drive-side connecting rod
12 lever
13 driven-side connecting rod
14 guide
15 lever fixing pin
16 first grooved cam
16A first straight line portion
16B connecting portion
16C second straight line portion
17 second grooved cam
18 movable pin
19 third grooved cam
20 driven-side moving pin
21 guide groove
22 posture holding member
23 fastening ring
24 drive-side fastening ring
25 fixing ring
26 movable pin fastening nut
27 moving pin fastening nut
28 lever driven-side hole
29 lever-fixing pin hole
30 drive-side guide
31 driven-side guide
32 torsional rotation center

The invention claimed is:

1. A gas circuit breaker in which a drive-side electrode and a driven-side electrode are provided so as to face each other inside a sealed tank, the drive-side electrode has a drive-side main electrode and a drive-side arcing contact, and the driven-side electrode includes a driven-side main electrode and a driven-side arcing contact, the drive-side arcing contact is connected to an actuator, and the driven-side arcing contact is connected to a double motion mechanism section, wherein the double motion mechanism section includes a drive-side connecting rod receiving a driving force from the drive-side electrode, a driven-side connecting rod connecting to the driven-side arcing contact, two levers operating the driven-side connecting rod in an opposite direction with respect to an operation of the drive-side connecting rod, and a guide in which the drive-side connecting rod and the driven-side connecting rod move thereinside, the two levers are arranged on both sides of the outside of the guide, which are fixed to each other so as to rotate freely by a lever fixing pin, a movable pin is connected to a first grooved cam formed in the drive-side connecting rod, a second grooved cam formed in the guide, and third grooved cams formed in the two levers respectively, a driven-side moving pin penetrates through lever driven-side holes of the two levers, which are arranged on both sides of the driven-side connecting rod, and a guide groove of the driven-side connecting rod, and posture holding members, which hold the movable pin so that an axis of the movable pin is approximately orthogonal to an opening/closing operation shaft of a circuit breaker part, and inner surfaces of the posture holding members, which touch outer surfaces of the two levers, are provided.

2. The gas circuit breaker according to claim 1, wherein at least two of the posture holding members are arranged in the movable pin, and the posture holding members contact the respective two levers.

3. The gas circuit breaker according to claim 2, wherein the movable pin moves in the first grooved cam, the second grooved cam and the third grooved cams respectively by an operation of the drive-side connecting rod, thereby rotating the levers, driving the driven-side connecting rod in an opposite direction of the drive-side connecting rod, and driving the driven-side arcing contact connecting to the driven-side connecting rod in an opposite direction of the drive-side arcing contact of the drive-side electrode connecting to the drive-side connecting rod.

4. The gas circuit breaker according to claim 3, wherein the first grooved cam includes a first straight line portion, a second straight line portion provided on a different axis from that of the first straight line portion, and a connecting portion connecting the first straight line portion and the second straight line portion, and a displacement width of the first grooved cam in a vertical direction falls within a displacement width of the second grooved cam in the vertical direction and a displacement width of the third grooved cam in the vertical direction.

5. The gas circuit breaker according to claim 4, wherein the levers are stationary when the movable pin moves on the first straight line portion and the second straight line portion, and the levers rotate around the lever fixing pin as a fulcrum when the movable pin moves on the connecting portion.

6. The gas circuit breaker according to claim 5,
wherein the movable pin moves in the second grooved cam and the third grooved cam respectively when the movable pin moves on the connecting portion.

7. The gas circuit breaker according to claim 6,
wherein the movable pin moves in the second straight line portion, the connecting portion and the first straight line portion in one direction in an opening operation, and
the movable pin moves in the first straight line portion, the connecting portion and the second straight line portion in one direction in a closing operation.

8. The gas circuit breaker according to claim 5,
wherein the movable pin moves in the second straight line portion, the connecting portion and the first straight line portion in one direction in an opening operation, and
the movable pin moves in the first straight line portion, the connecting portion and the second straight line portion in one direction in a closing operation.

9. The gas circuit breaker according to claim 4,
wherein the movable pin moves in the second grooved cam and the third grooved cam respectively when the movable pin moves on the connecting portion.

10. The gas circuit breaker according to claim 9,
wherein the movable pin moves in the second straight line portion, the connecting portion and the first straight line portion in one direction in an opening operation, and
the movable pin moves in the first straight line portion, the connecting portion and the second straight line portion in one direction in a closing operation.

11. The gas circuit breaker according to claim 4,
wherein the movable pin moves in the second straight line portion, the connecting portion and the first straight line portion in one direction in an opening operation, and
the movable pin moves in the first straight line portion, the connecting portion and the second straight line portion in one direction in a closing operation.

12. The gas circuit breaker according to claim 4,
wherein a positional relation among the first straight line portion, the second straight line portion and the connecting portion of the first grooved cam, the second grooved cam and the third grooved cam is determined by a speed ratio of an operation of the driven-side electrode with respect to an operation of the drive-side electrode.

* * * * *